US008776668B2

(12) United States Patent
Spielvogel et al.

(10) Patent No.: US 8,776,668 B2
(45) Date of Patent: Jul. 15, 2014

(54) MACHINE HOUSING OF A HYDRAULIC MACHINE

(75) Inventors: Christian Spielvogel, Horb (DE); Martin Zug, Hirrlingen (DE)

(73) Assignee: Robert Bosch GmbH, Stuttgart (DE)

( * ) Notice: Subject to any disclaimer, the term of this patent is extended or adjusted under 35 U.S.C. 154(b) by 730 days.

(21) Appl. No.: 13/085,899

(22) Filed: Apr. 13, 2011

(65) Prior Publication Data

US 2011/0252958 A1 Oct. 20, 2011

(30) Foreign Application Priority Data

Apr. 16, 2010 (DE) ..... 10 2010 015 189

(51) Int. Cl.
*F04B 53/16* (2006.01)

(52) U.S. Cl.
USPC ..... 92/12.2; 92/128

(58) Field of Classification Search
USPC ..... 92/12.2, 71, 128
See application file for complete search history.

(56) References Cited

U.S. PATENT DOCUMENTS

| | | | | |
|---|---|---|---|---|
| 3,527,552 | A * | 9/1970 | Lincks et al. | 418/24 |
| 4,018,139 | A * | 4/1977 | Landreau | 91/490 |
| 4,634,354 | A * | 1/1987 | Dantlgraber | 418/31 |
| 5,671,653 | A * | 9/1997 | Martensen et al. | 92/71 |
| 2009/0013864 | A1 * | 1/2009 | Mohn et al. | 92/71 |

FOREIGN PATENT DOCUMENTS

| | | |
|---|---|---|
| DE | 3425013 | 7/1987 |
| EP | 0421020 | 4/1991 |

* cited by examiner

*Primary Examiner* — Thomas E Lazo
(74) *Attorney, Agent, or Firm* — Maginot, Moore & Beck

(57) ABSTRACT

A machine housing of a piston machine is disclosed. The machine housing is formed in two parts. The machine housing has a main housing which is closed off by a connection plate. Here, the connection plate is screwed to the main housing by means of a plurality of screws, and is positioned with low tolerances with respect to said main housing by means of two centering pins. Here, the centering pins are arranged with twofold rotational symmetry with respect to a shaft axis of a drive shaft of the piston machine. In contrast, screw positions do not have rotational symmetry with respect to said shaft axis. This prevents incorrect mounting of the connection plate.

6 Claims, 3 Drawing Sheets

MACHINE HOUSING OF A HYDRAULIC MACHINE

This application claims priority under 35 U.S.C. §119 to German patent application no. 10 2010 015 189.0, filed Apr. 16, 2010 in Germany, the disclosure of which is incorporated herein by reference in its entirety.

BACKGROUND

The disclosure relates to a machine housing of a hydraulic machine.

DE 34 25 013 C2 discloses a machine housing of said type. Said machine housing has an approximately pot-shaped housing section for accommodating a drive gear of a rotary piston pump, which housing section is closed off by a housing cover. The housing cover has a projection which has a round cylindrical cross section and which, to center the housing cover, protrudes with low manufacturing tolerances into an interior space, which likewise has a round cylindrical cross section, of the housing section. Here, the projection is rotationally symmetrical with respect to a drive shaft of the rotary piston pump. The housing cover is fixed to the housing section by means of four screws which are arranged adjacent to the projection and which, for reasons of strength, are arranged rotationally asymmetrically with respect to the drive shaft. It is a disadvantage here that the centering of the housing cover entails a high level of manufacturing technology outlay and therefore high production costs.

EP 0 421 020 B1 presents a further machine housing for a hydraulic machine. The hydraulic machine is a gearwheel-type machine whose drive gear is accommodated in a hollow cylindrical housing section which is closed off on both end sides by a housing cover. A respective housing cover is fixed to the housing section by means of four screws and is positioned by means of in each case two dowel pins or centering pins. The dowel pin positions and the screw positions each have twofold rotational symmetry with respect to a common axis. As a result, it is possible for a respective housing cover to be mounted incorrectly by being mounted on the housing section having been rotated through 180 degrees with respect to the axis. The incorrect mounting can lead to damage during use of the hydraulic machine, or additional outlay in terms of assembly is required in order to arrange the housing cover correctly.

In contrast, the object on which the disclosure is based is that of providing a machine housing for a hydraulic machine, which machine housing can be produced cost-effectively and mounted securely.

Said object is achieved by means of a machine housing having the features set forth herein.

SUMMARY

According to the disclosure, a machine housing for a hydraulic machine has a housing section for accommodating a drive gear of the hydraulic machine. To close off the housing section, a connection plate is provided which is connected to the housing section by means of screws. To center the connection plate on the housing section, two centering pins or dowel pins are provided between the housing section and the connection plate. Here, dowel pin positions have twofold rotational symmetry with respect to a shaft axis of a drive shaft of the hydraulic machine, whereas screw positions do not have rotational symmetry with respect to said shaft axis.

Said solution has the advantage that incorrect mounting, such as can occur in the prior art explained in the introduction, is prevented with little outlay in terms of equipment and therefore low production costs, because the connection plate can be screwed to the housing section only in a single position. High time and cost outlay resulting from incorrect mounting can therefore be avoided. Furthermore, as a result of the twofold rotational symmetry of the dowel pin positions, simple manufacture of the dowel pin receptacles is made possible, and outlay in terms of alignment for the dowel pin positions is extremely low, as a result of which extremely low tolerances of the dowel pin positions are made possible with little outlay in terms of manufacturing.

It is preferable for four screws to be provided which are arranged approximately at corners of a geometric rectangle, the central point being offset relative to the shaft axis.

In a further embodiment of the disclosure, the screw positions have an approximately equal spacing to a first plane. Said first plane extends approximately through a pivot axis of a pivotable swashplate of the drive gear of the hydraulic machine and approximately parallel to the shaft axis.

The screw positions may also have an equal spacing to a second plane. Said second plane runs approximately through the shaft axis and approximately orthogonally with respect to the pivot axis of the swashplate.

It is preferable for the pivot axis of the swashplate to extend approximately perpendicular to and be spaced apart from the shaft axis. In this way, the swashplate is subjected to a torque about the pivot axis imparted by pistons which are supported on the swashplate, as a result of which only one actuating piston of an actuating cylinder is required for imparting a counteracting torque.

The hydraulic machine is preferably a swashplate-type axial piston machine.

Further advantageous refinements of the disclosure are provided herein.

BRIEF DESCRIPTION OF THE DRAWINGS

A preferred exemplary embodiment of the disclosure will be explained in more detail below on the basis of schematic drawings, in which.

DETAILED DESCRIPTION

Figure 1:
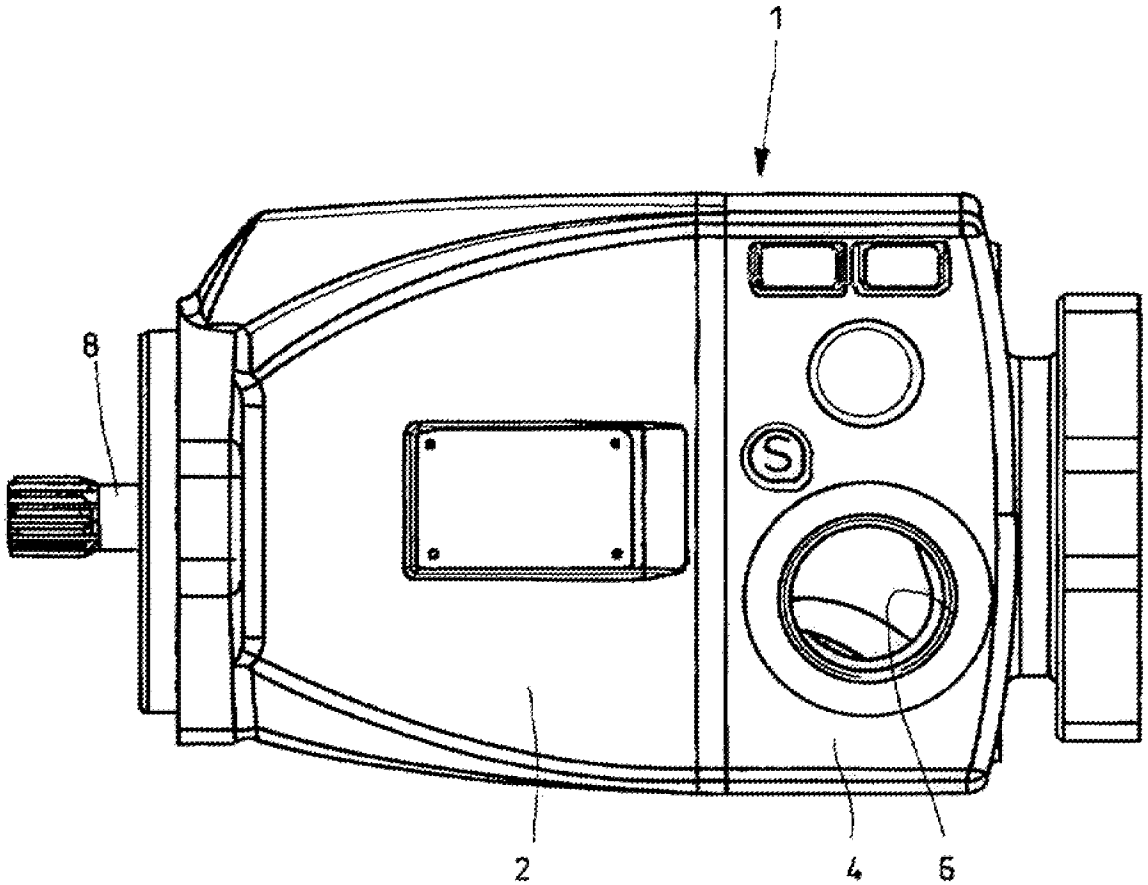
FIG. 1 shows a side view of a machine housing according to an exemplary embodiment.

FIG. 1 illustrates a side view of a machine housing 1 according to the disclosure of a hydraulic machine, according to an exemplary embodiment. The hydraulic machine is a swashplate-type axial piston machine which is used as a hydraulic pump. The machine housing 1 has a housing section 2 and a connection plate 4 which is fastened thereto and which sealingly closes off the housing section 2. The connection plate 4 has in each case one connection opening on opposite side surfaces, wherein one connection opening is illustrated in FIG. 1 and is denoted by the reference numeral 6. Here, one connection opening serves as a pressure connection while the other is used as a suction connection of the hydraulic pump. The hydraulic pump is therefore connected via the connection openings to a hydraulic circuit.

A drive shaft 8, which protrudes to the left in FIG. 1, extends all the way through the housing section 2 and the connection plate 4 in its longitudinal direction. The point at which the connection plate 4 is extended through (not illustrated) serves as a through-drive of the drive shaft 8.

Figure 2:
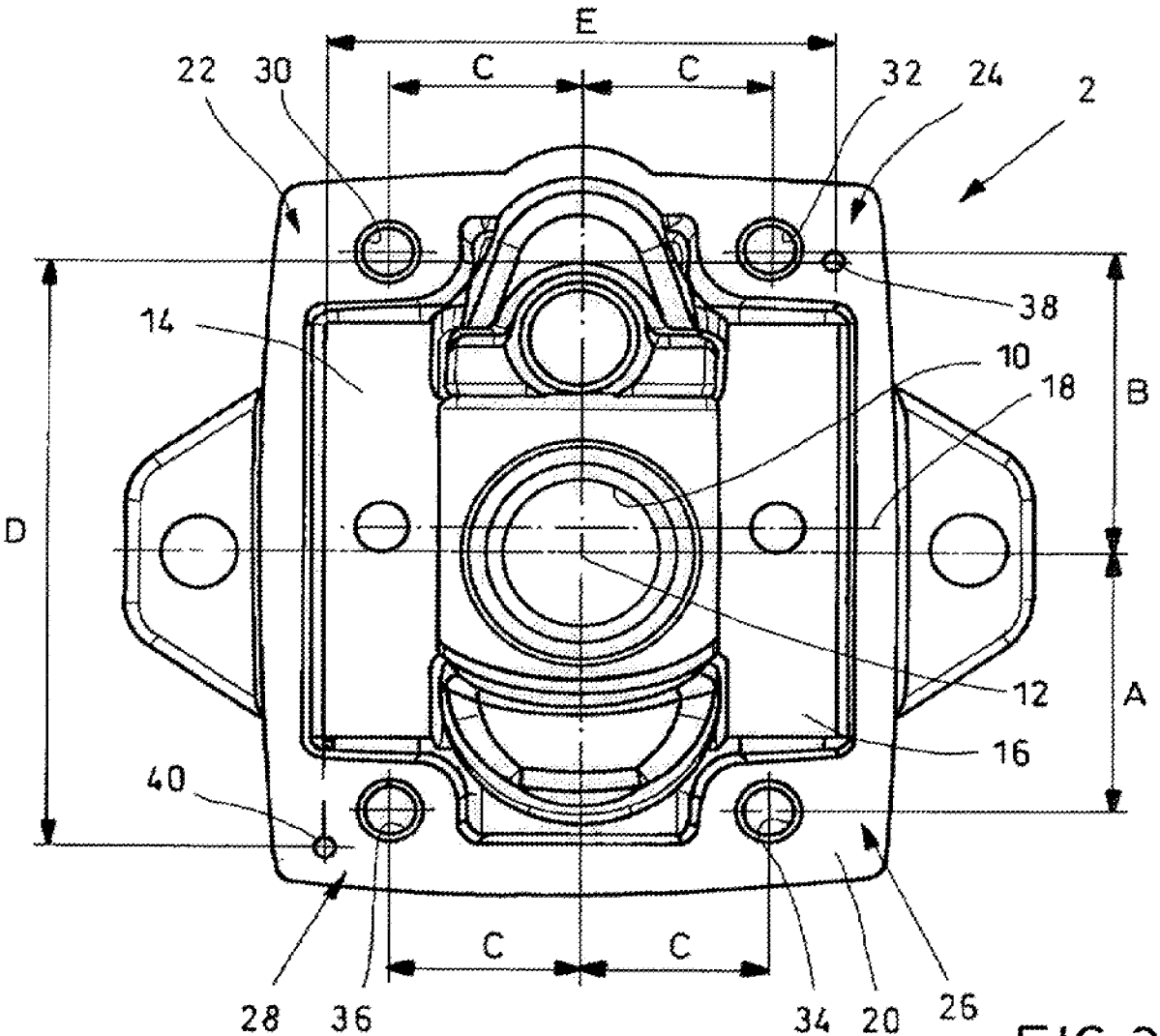
FIG. 2 shows a front view of a housing section of the machine housing from FIG. 1.

FIG. 2 illustrates the housing section 2 in a front view (the viewing direction being from the connection plate 4 in the direction of the housing section 2 in FIG. 1). Here, only the housing section 2 is illustrated, without a drive gear of the hydraulic machine accommodated therein. The housing section 2 is of pot-shaped design. A housing opening 10 for the drive shaft 8, which extends through the housing section 2, from FIG. 1 is formed in the base of the housing in the central region of the housing section 2. An axis, which extends approximately perpendicular to the plane of the drawing, of the housing opening 10 corresponds to a shaft axis 12 of the drive shaft 8.

Two approximately semi-circular bearing shells 14, 16 which are parallel to and spaced apart from one another in the region of the housing base are formed in the housing section 2 laterally offset with respect to the shaft axis 12 to the left and right in FIG. 2. Said bearing shells serve for mounting a swashplate (not illustrated) of the hydraulic pump, the pivot axis 18 of which swashplate runs approximately perpendicular to and is spaced apart from the shaft axis 12. In FIG. 2, the pivot axis 18 is arranged above the shaft axis 12. A multiplicity of pistons (not illustrated) of the hydraulic pump are mounted on the swashplate, which pistons extend approximately parallel to the shaft axis 12 and in each case delimit a swept volume in a cylinder barrel in which they are guided. Here, the cylinder barrel is fixedly connected to the drive shaft 8 from FIG. 1. The cylinder barrel is supported in a sliding fashion on a control plate mounted in a rotationally fixed manner between the connection plate 4 and the cylinder barrel. A piston stroke of the piston, and therefore a variable displacement volume of the hydraulic pump, can be set by varying an angle of inclination of the swashplate. For more detailed information regarding the drive gear of the hydraulic machine, reference is made to the book entitled "Der Hydrauliktrainer, Band 1" ["The Hydraulic Trainer, Volume 1"], 3rd edition, from Bosch Rexroth AG.

As a result of the spacing of the pivot axis 18 from the shaft axis 12, easier adjustment of the swashplate is made possible because the pistons which are supported on the swashplate—and which are arranged rotationally symmetrically about the shaft axis 12—are spaced apart differently from the pivot axis 18. In this way, a resultant torque acts about the pivot axis 18 on forces transmitted from the piston to the swashplate, which resultant torque needs to be counteracted with a counteracting torque only by one actuating cylinder for adjusting the swashplate. In FIG. 2, the actuating cylinder is arranged above the shaft axis 12.

Proceeding from an end side 20 of the housing section 2, a threaded bore 30, 32, 34 and 36 for receiving a screw for screwing the connection plate 4 from FIG. 1 is formed in a respective corner region 22, 24, 26 and 28. The threaded bores 30 to 36 extend approximately parallel to the shaft axis 12 with a spacing C from a which extends approximately through the shaft axis 12 and runs approximately perpendicular to the pivot axis 18, the spacing C being measured perpendicular to said plane. Furthermore, a spacing of the threaded bores 30 to 36 to a plane which runs along the pivot axis 18 and extends parallel to the shaft axis 12 is likewise equal, wherein said spacing is also measured perpendicular to said plane. The axes of the threaded bores 30 to 36 are arranged in each case at a corner of a geometric rectangle (not shown) whose central point is offset with respect to the shaft axis 12. The upper threaded bores 30 and 32 in FIG. 2 are arranged here such that a spacing B between the axes of the threaded bores 30, 32 and the shaft axis 12 is greater than a spacing A between axes of the lower threaded bores 34 and 36 in FIG. 2 and the shaft axis 12 (here, the spacings are again measured perpendicular to the plane which lies in the pivot axis 18 and which runs parallel to the shaft axis 12).

In FIG. 2, a dowel hole 38, 40 designed as a blind bore is formed in the right-hand upper corner region 24 and in the left-hand lower corner region 28 in each case proceeding from the end side 20 of the housing section 2, which dowel holes serve for receiving in each case one dowel pin which again serves for centering the connection plate 4 from FIG. 1. Here, the dowel holes 38, 40 are arranged so as to have twofold rotational symmetry with respect to the shaft axis 12. A spacing D of axes of the dowel holes 38, 40, which spacing is measured parallel to a plane which runs in the shaft axis 12 and which extends perpendicular to the pivot axis 18, is greater here than a spacing E between said axes which is measured perpendicular to said plane.

Figure 3:
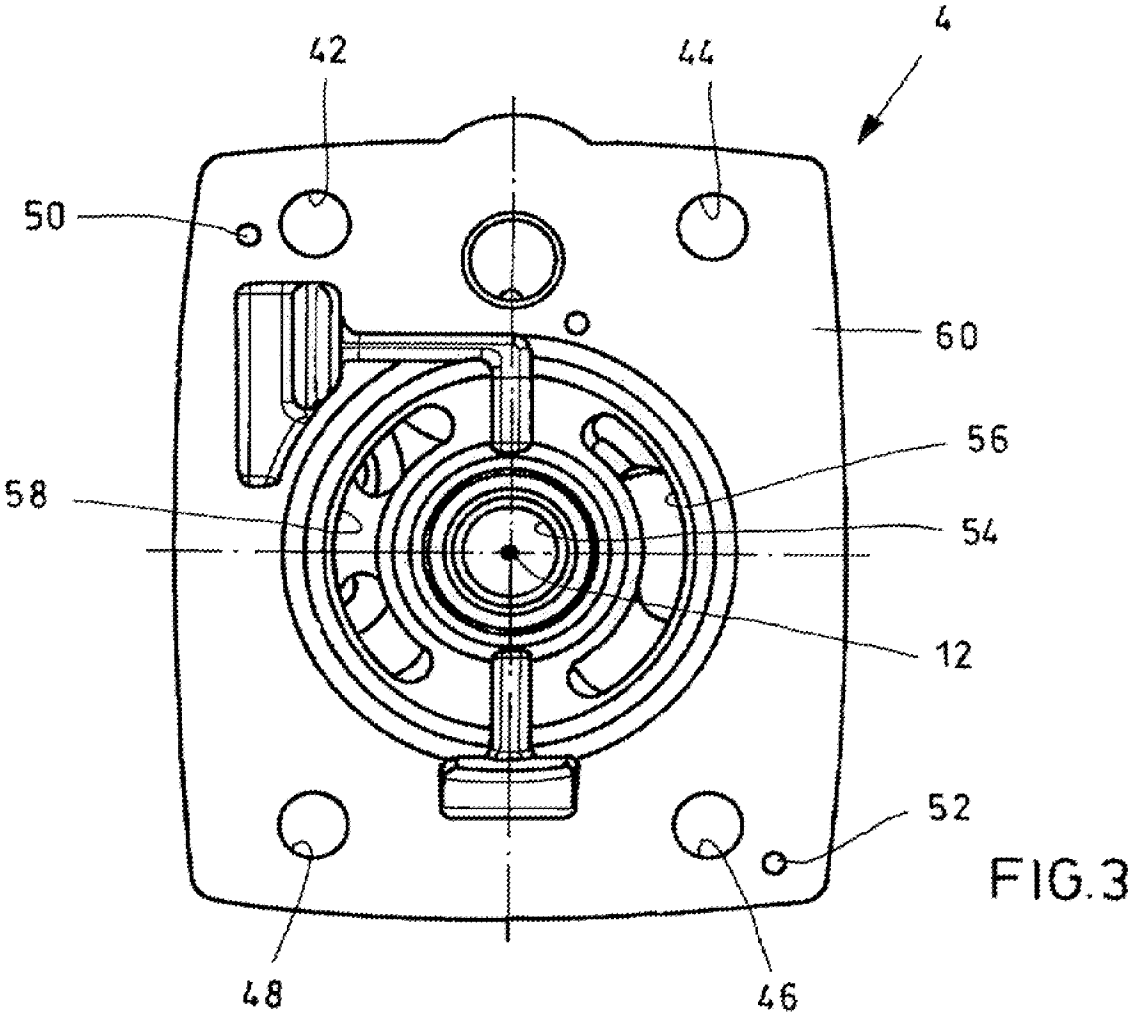
FIG. 3 shows a front view of a connection plate of the machine housing from FIG. 1.

FIG. 3 shows a front view of the connection plate 4 from FIG. 1 (the viewing direction being from the housing section 2 in the direction of the connection plate 4 in FIG. 1). To fasten the connection plate 4 to the housing section 2 by means of screws, said connection plate has through bores 42, 44, 46 and 48 arranged correspondingly to the threaded bores 30 to 36 from FIG. 2. Furthermore, to receive the dowel pins between the connection plate 4 and the housing section 2, there are provided in the connection plate 4 two dowel holes 50, 52 which are formed as blind bores and which are arranged correspondingly to the dowel holes 38, 40 from FIG. 2. The spacings of the through bores 42 to 48 and of the dowel holes 50, 52 therefore correspond to those from FIG. 2. A through drive 54 for the drive shaft 8 is provided in the connection plate 4 approximately coaxially with respect to the shaft axis 12. Said drive shaft 8 is engaged around in sections by two kidney-shaped slots 56, 58 which are formed in the connection plate 4 and which are formed proceeding from that end side 60 of the connection plate 4 which points toward the housing section 2. The slots 56, 58 serve for connecting the hydraulic pump to the connection openings mentioned in the introduction, and therefore for connecting the hydraulic pump to a hydraulic circuit.

To mount the connection plate 4 on the housing section 2, dowel pins (not illustrated) are inserted into a dowel hole 50, 52 of the connection plate 4 or into a dowel hole 38, 40 of the housing section 2. In the assembled state of the connection plate 4 and of the housing section 2, these are centered with respect to one another with extremely low tolerances by means of the dowel pins. To fix the connection plate 4 to the housing section 2, screws are then inserted through a respective through opening 42 to 48 of the connection plate 4 and screwed into a respective threaded bore 30 to 36 of the housing section 2.

As a result of the twofold rotational symmetry of the dowel holes 38, 40, 50, 52 with respect to the shaft axis 12, and the threaded bores 30 to 36 and through bores 42 to 48 which do not have rotational symmetry with respect to said shaft axis, incorrect mounting as can occur in the prior art explained in the introduction is no longer possible.

As a result of the twofold rotational symmetry of the dowel hole 38 to 52, these are easy to manufacture, and easy alignment of their positions is made possible.

Disclosed is a machine housing of a piston machine, which machine housing is formed in two parts. The machine housing has a main housing which is closed off by a connection plate. Here, the connection plate is screwed to the main housing by means of a plurality of screws, and is positioned with low tolerances with respect to said main housing by means of two centering pins. Here, the centering pins are arranged with twofold rotational symmetry with respect to a shaft axis of a drive shaft of the piston machine. In contrast, screw positions do not have rotational symmetry with respect to said shaft axis. This prevents incorrect mounting of the connection plate.

What is claimed is:

1. A machine housing of a hydraulic machine, having a housing section for accommodating a drive gear of the hydraulic machine, wherein said housing section is closed off by means of a connection plate which is connected to the housing section by means of screws, wherein to center the connection plate, two dowel pins are provided between the housing section and the connection plate, wherein dowel pin positions have twofold rotational symmetry and screw positions do not have rotational symmetry with respect to a shaft axis of a drive shaft of the hydraulic machine.

2. The machine housing according to claim 1, with four screws being provided which are arranged approximately at corners of a geometric rectangle whose central point is offset relative to the shaft axis.

3. The machine housing according to claim 1, with the screw position having an approximately equal spacing to a first plane which extends approximately through a pivot axis of a pivotable swashplate of the drive gear and runs approximately parallel to the shaft axis.

4. The machine housing according to claim 3, with the screw positions having an equal spacing to a second plane which extends approximately through the shaft axis and runs approximately orthogonally with respect to the pivot axis of the swashplate.

5. The machine housing according to claim 3, with the pivot axis of the swashplate running approximately perpendicular to and being spaced apart from the shaft axis.

6. The machine housing according to claim 1, with the hydraulic machine being a swashplate-type axial piston machine.

* * * * *